US006073331A

United States Patent [19]

Katsumura et al.

[11] Patent Number: 6,073,331

[45] **Date of Patent: *Jun. 13, 2000**

[54] METHOD FOR MANUFACTURING SEAMLESS PIPE

[75] Inventors: Tatsuro Katsumura; Takashi Ariizumi, both of Tokyo, Japan

[73] Assignee: NKK Corporation, Tokyo, Japan

[ * ] Notice: This patent is subject to a terminal disclaimer.

[21] Appl. No.: 09/010,003

[22] Filed: Jan. 21, 1998

Related U.S. Application Data

[62] Division of application No. 08/645,223, May 13, 1996, Pat. No. 5,778,714.

[30] Foreign Application Priority Data

| | | | |
|---|---|---|---|
| May 19, 1995 | [JP] | Japan | 7-145673 |
| Jun. 6, 1995 | [JP] | Japan | 7-162824 |
| Jul. 4, 1995 | [JP] | Japan | 7-168634 |

[51] Int. Cl.[7] ..... B21B 19/04; B21B 17/40; B21B 45/02

[52] U.S. Cl. ..... 29/423; 72/97; 72/42; 72/209

[58] Field of Search ..... 29/423; 72/97, 72/42, 209

[56] References Cited

U.S. PATENT DOCUMENTS

| | | | |
|---|---|---|---|
| 2,791,924 | 5/1957 | Sawyer . | |
| 3,818,733 | 6/1974 | Cauley et al. | 72/41 |
| 5,031,434 | 7/1991 | Takase et al. | 72/97 |
| 5,816,087 | 10/1998 | Katsumura et al. . | |

FOREIGN PATENT DOCUMENTS

| | | |
|---|---|---|
| 56-89307 | 7/1981 | Japan . |
| 61-137612 | 6/1986 | Japan . |
| 62-207503 | 9/1987 | Japan . |
| 62-244505 | 10/1987 | Japan . |

(List continued on next page.)

OTHER PUBLICATIONS

Patent Abstracts of Japan, vol. 005, No. 162 (M–092), Oct. 17, 1981 of JP–A–56 089307 (Kawasaki Steel Corp), Jul. 20, 1981.

Patent Abstracts of Japan, vol. 015. No. 325 (M–1148), Aug. 19, 1981 of JP–A–03 124305 (Nippon Steel Corp), May 27, 1991.

Patent Abstracts of Japan, vol. 018, No. 034 (M–1544), Jan. 19, 1994 of JP–A–05 269507 (Sumitomo Metal Ind Ltd), Oct. 19, 1993.

Patent Abstracts of Japan, vol. 016, No. 359 (M–1289), Aug. 4, 1992 of JP–A–04 111906 (Nippon Steel Corp), Apr. 13, 1992.

Patent Abstracts of Japan, vol. 015, No. 025 (M–1701), Jan. 21, 1991 of JP–A–02 268909 (NKK Corp), Nov. 2, 1990.

Patent Abstracts of Japan, vol. 013, No. 041 (M–791), Jan. 30, 1989 of JP–A–63 248502 (Sumitomo Metal Ind Ltd), Oct. 1988.

Patent Abstracts of Japan, vol. 012, No. 454 (M–769), Nov. 29, 1988 of JP–A–63 183707 (Sumitomo Metal Ind Ltd), Jul. 29, 1988.

Patent Abstracts of Japan, vol. 010, No. 333 (M–534), Nov. 12, 1986 of JP–A–61 137612 (Sumitomo Metal Ind Ltd), Jun. 25, 1986.

(List continued on next page.)

*Primary Examiner*—P. W. Echols
*Assistant Examiner*—John Hong
*Attorney, Agent, or Firm*—Frishauf, Holtz, Goodman, Langer & Chick, P.C.

[57] ABSTRACT

A method for manufacturing a seamless pipe, comprises:

preparing a billet made of an alloy steel or an alloy;

joining a steel plate to an end surface at which piercing of the billet is commenced;

preparing a piercing plug made of Mo, a Mo alloy or a heat-resisting steel;

hot-piercing the billet by using the piercing plug to produce a hollow shell; and rolling the hollow shell to produce a seamless pipe.

7 Claims, 6 Drawing Sheets

FOREIGN PATENT DOCUMENTS

| | | |
|---|---|---|
| 63-183707 | 7/1988 | Japan . |
| 63-192504 | 8/1988 | Japan . |
| 63-54066 | 10/1988 | Japan . |
| 1-266905 | 10/1989 | Japan . |
| 2-133106 | 5/1990 | Japan . |
| 2-268909 | 11/1990 | Japan . |
| 2-284708 | 11/1990 | Japan . |
| 3-124305 | 5/1991 | Japan . |
| 4-111906 | 4/1992 | Japan . |
| 4-274806 | 9/1992 | Japan . |
| 5-269507 | 10/1993 | Japan . |
| 63-248502 | 10/1998 | Japan . |
| 870750 | 6/1961 | United Kingdom . |

OTHER PUBLICATIONS

Patent Abstracts of Japan, vol. 017, No. 068 (M–1365), Feb. 10, 1993 of JP–A–04 274806 (Nippon Steel Corp.), Sep. 30, 1992.

Patent Abstracts of Japan, vol. 014, No. 026 (M–921), Jan. 18, 1990 of JP–A–01 266905 (Nippon Steel Corp.), Oct. 24, 1989.

METHOD FOR MANUFACTURING SEAMLESS PIPE

This is a division of application Ser. No. 08/645,223 filed May 13, 1996, now U.S. Pat. No. 5,778,714.

BACKGROUND OF THE INVENTION

1. Field of the Invention

The present invention relates to a method for manufacturing a seamless pipe, and more particularly, to a method for manufacturing a seamless steel pipe and a seamless metal pipe.

2. Description of the Related Arts

In general, a seamless steel pipe is produced by preparing a billet having a round or a square cross-section, forming a hollow shell by a method such as Mannesmann piercing, press piercing or hot extrusion, and rolling the thus-formed hollow shell by a rolling mill such as an elongater, plug mill or a mandrel mill and subjecting the rolled hollow shell to a sizing work performed with a sizer or a stretch reducer, whereby the final pipe product of a predetermined size is obtained (hereinafter called a "continuous rolling process").

The piercing plug for use in Mannesmann piercing and press piercing is always held in contact with a billet heated to a high temperature of 1100 to 1300° C., and the plug is required to sustain a heavy load. Therefore, the piercing plug is damaged during the piercing work. Although a conventional piercing plug is able to withstand several hundreds of piercing cycles when used for piercing a billet made of, for example, a carbon steel (a low-alloy steel), the piercing plug is damaged considerably as shown in FIGS. 4 and 5 when used to pierce billets made of a high-alloy steel exemplified by a stainless steel such as 13 Cr steel, SUS 304 and SUS 316, or a high alloy (hereinafter called a "high-alloy steel or the like"), the main component of which is Cr, Ni or Mo, represented by a high alloy containing, as a main component thereof, not lower than 25 wt % Ni. Thus, the piercing work can be performed only several times. In the worst case, the piercing work cannot be performed. FIGS. 4 and 5 are side views showing a damaged piercing plug. Referring to FIGS. 4 and 5, reference numeral 1 represents a piercing plug itself, 5 represents a deformation of the leading end due to melting, 6 represents a crease damage in the body and 7 represents a seizure of the material of the piercing plug. As described above, the life of the piercing plug, which can be used in hundreds of cycles when used to pierce a carbon steel billet, is extremely shortened if it is used to pierce a billet made of the foregoing high-alloy steel. Therefore, the foregoing problem leads to enlargement of the tool cost, deterioration in the efficiency in the rolling work due to change in the damaged tool, enlargement of the manufacturing cost and, even impossibility of the manufacturing operation.

To overcome the deterioration in the durability of the plug when used to pierce a billet made of the foregoing high-alloy steel, a multiplicity of techniques (1) to (4) below have been suggested:

(1) To use, as the material of the piercing plug, a material, such as Mo (molybdenum), having a greater high-temperature strength than that of the alloy steel to prevent the plug from being damaged due to deformation.

(2) A lubricant is supplied through a portion of the surface of the plug so as to be applied between the hollow shell and the plug to prevent damage taking place due to seizure.

(3) A hard material or the like is allowed to adhere to the surface of the plug by surface treatment to prevent the seizure and abrasion to improve the durability of the plug.

(4) To use a scale produced due to oxidation as a lubricant, the environment in which the heat treatment for the plug and the like are changed to thicken and raise the density of the scale to improve the durability.

The following partial modifications of the foregoing techniques (1) to (4) have been disclosed:

As a modification of art (1), Japanese Patent Laid-Open No. 2-133106 (hereinafter called "prior art 1");

As a modification of art (2), Japanese Patent Laid-Open No. 2-284708 (hereinafter called "prior art 2");

As a modification of art (3), Japanese Patent Laid-Open No. 63-192504 (hereinafter called "prior art 3"); and As a modification of art (4), Japanese Patent Publication No. 63-54066 (hereinafter called "prior art 4").

It is to be understood, however, that only few cases have been successfully carried out in the prior arts stated above.

The prior art 2 encounters with difficulties in the supply of lubricant in successive piercing cycles, although it can eliminate a seizure between the billet and the plug in at least the first piercing cycle. Supply of lubricant is possible by a different method: namely, through the head of the plug via a passage formed in a plug bar in support of the plug. This method, however, involves a problem in regard to damaging of the plug end or clogging of the same and, hence, cannot be continuously used in actual piercing mills.

A technique considered to be most widely used and in which a piercing plug made of a low-alloy steel, such as 3Cr-1Ni (hereinafter called a "known component") is subjected to heat treatment prior to performing the piercing work to use the produced surface scale as the lubricant is advantageous in view of improving durability similarly to the conventional piercing method. However, the obtained piercing plug can be used in only about 10 cycles which is unsatisfactory as compared with the case where the same is used to pierce common steels. Thus, reduction in the tool cost and improvement in the efficiency in the rolling work cannot be realized.

The prior art 1 relying upon the use of Mo as the plug material has many advantages such as prevention of deformation of the plug itself, prevention of seizure, and so forth. Mo, however, is expensive and the plug made of this material is rather fragile in a temperature range of about 400° C. or less. Due to the foregoing fact and a fact that the plug of the foregoing type can easily be broken due to thermal stress, there are many problems in using industrially.

Although the prior art 3 is able to prevent damage of the plug because a abrasion resistance layer is provided, the abrasion resistance layer made of hard material can easily be cracked due to repeated thermal stress and the layer subjected to the heat treatment separates easily. This method therefore has not yet been matured to such a level as to be practically used on actual machines.

Accordingly, plugs have been disclosed in Japanese Patent Laid-Open No. 62-207503 (hereinafter called a "prior art 5") and Japanese Patent Laid-Open No. 62-244505 (hereinafter called a "prior art 6") as a means capable of elongating the life of the piercing plug and enabling the piercing plug to be manufactured at low cost in which Mo or a Mo alloy or ceramics exhibiting excellent wear resistance is disposed at the leading end of the plug and the body is subjected to the conventional oxidation process or structure.

The plug disclosed in the known arts 5 and 6 (hereinafter called a "composite plug") has the structure such that only the leading portion of the plug, which is applied with a large stress and load, is made of the foregoing strong material, such as Mo, because the cost is increased excessively if the overall body of the piercing plug is made of the foregoing material, and the other portion is made of a low-cost alloy steel to reduce the cost of the tool. The cost per one piercing operation can be reduced to the cost required for the conventional technique and an effect can be improved because the efficiency in the rolling operation can be improved.

However, the foregoing technique cannot reduce the thermal stress taking place due to the friction between the material of the billet and the body of the plug during the operation. Therefore, cracks taking place due to the thermal stress cannot be prevented. Since the oxidation scale applied to the body of the plug is similar to that applied in the conventional techniques, damage of the body due to the piercing work results in the quality and accuracy of a product being excessively deteriorated in its internal surface even if the head of the plug is sound for use. As a result, the manufacturing cost cannot be reduced.

The foregoing problems experienced with the prior arts are as follows:

In the case where the piercing plug is made of the alloy steel of the conventional component or the low-alloy steel, heat applied to the plug from the material to be pierced or rise in the temperature due to heat generated during the work of the material results in deterioration of the strength. Thus, the piercing plug is melted and deformed due to the load applied during the piercing work.

In the case where the piercing plug made of the alloy steel is used to pierce a work piece (billet) which damages the piercing plug, use of the wear-resisting plug having a hardened surface or a plug made of a heat-resisting alloy or Mo or a Mo alloy results mainly in the surface being cracked. Thus, the durability of the plug cannot be improved. In the case where the composite plug is used, damage of the body of the plug inhibits solving of the problem. Therefore, a method of elongating the life of the piercing plug having effects in reducing the manufacturing cost and improvement in the efficiency in the rolling work has not been established yet.

As described above, when a seamless pipe is manufactured from the billet made of the high-alloy steel or the like by the continuous rolling process using Mannesmann piercing, a technique has been desired with which the durability of the piercing plug can be elongated considerably as compared with the conventional method and the manufacturing cost can be reduced.

SUMMARY OF THE INVENTION

It is an object of the present invention to provide a method for manufacturing a seamless pipe wherein the durability of the piercing plug can be elongated considerably and the manufacturing cost can be reduced.

To attain the object, firstly, the present invention provide a method for manufacturing a seamless pipe, comprising the steps of:

preparing a billet made of an alloy steel or an alloy;

joining a steel plate at least to an end surface at which piercing of the billet is commenced;

preparing a piercing plug made of at least one selected from the group consisting of Mo, a Mo alloy or a heat-resisting steel;

hot-piercing the billet, to which the steel plate is joined, by using the piercing plug to produce a hollow shell; and rolling the hollow shell to produce a seamless pipe.

The billet can be made of an alloy steel containing Cr in an amount of at least 5 wt %, or an alloy steel containing Ni in an amount of at least 5 wt %. The billet can be made of an alloy, the main component of which is selected from the group consisting of Cr, Ni and Mo.

Concerning the piercing plug, it is preferable that the piercing plug comprises a main body made of any one of Mo, a Mo alloy and a heat-resisting steel and a hard layer formed on the surface of the main body. The hard layer is made of any one selected from a group consisting of stellite, ceramics obtained by adding tungsten carbide to stellite, ceramics obtained by adding a mixture composition of tungsten carbide and cobalt to stellite and ceramics obtained by adding a compound of chromium and carbon to stellite. It is also preferable that the piercing plug comprises a plug body made of any one of Mo, a Mo alloy and a heat-resisting steel and a plug head formed at the leading end of the plug body and made of any one of Mo, a Mo alloy and a heat-resisting steel. The plug body can have a hard layer formed on the surface of the plug body. The plug head can have a hard layer formed on the surface of the plug head.

Secondly, the present invention provide a method for manufacturing a seamless pipe, comprising the steps of:

preparing a billet made of an alloy steel or an alloy;

joining a steel plate at least to an end surface at which piercing of the billet is commenced, the steel plate being subjected to an oxidation treatment;

heating the billet to which the steel plate is joined;

hot-piercing the heated billet by using a piercing plug to produce a hollow shell; and rolling the hollow shell to produce a seamless pipe.

The billet can be made of an alloy steel containing Cr in an amount of at least 5 wt %, or an alloy steel containing Ni in an amount of at least 5 wt %. The billet can be made of an alloy, the main component of which is selected from the group consisting of Cr, Ni and Mo. The steel plate can be made of a carbon steel. Also, the steel plate can be made of an alloy steel containing one element selected from the group consisting of C in an amount of less than 5 wt %, Cr in an amount of less than 5 wt % and Ni in an amount of less than 5 wt %. Moreover, the steel plate can be made of an alloy steel containig Si in an amount of 1 wt % or more. The steel plate can be joined to the billet by welding.

Thirdly, the present invention provide a method for manufacturing a seamless pipe, comprising the steps of:

preparing a billet made of an alloy steel or an alloy;

heating the billet in a heating furnace;

joining a steel plate at least to an end surface at which piercing of the heated billet is commenced, the steel plate being subjected to an oxidation treatment;

hot-piercing the billet, to which the steel plate is joined, by using a piercing plug to produce a hollow shell; and rolling the hollow shell to produce a seamless pipe.

Fourthly, the present invention provide a method for manufacturing a seamless pipe, comprising the steps of:

preparing a billet made of a high alloy steel or a high alloy;

preparing a piercing plug which satisfies the following equation: $0.8° \leqq \alpha - \beta \leqq 1.5°$ wherein $\alpha$ is an angle of a plug reeling portion and $\beta$ is an angle at an outlet portion of a roll; and hot-piercing the billet by using the piercing plug to produce a hollow shell; and rolling the hollow shell to produce a seamless pipe.

DESCRIPTION OF THE EMBODIMENT

EMBODIMENT 1

The method for manufacturing a seamless pipe of the embodiment-1 comprises the steps of: preparing a billet; joining a steel plate to at least an end surface; preparing a piercing plug; hot-piercing the billet to produce a hollow shell; and rolling the hollow shell to produce a seamless pipe.

In the step of preparing the billet, the billet is made of an alloy steel or an alloy. The alloy steel is selected from an alloy steel containing Cr in an amount of at least 5 wt %, or an alloy steel containing Ni in an amount of at least 5 wt %. The alloy includes one element selected from the group consisting of Cr, Ni and Mo as the main component.

In the step of joining the steel plate, the steel plate is joined at least to an end surface at which piercing of the billet is commenced. The steel plate can be joined at both end surfaces of the billet.

The piercing plug is made of Mo, a Mo alloy or a heat-resisting steel. The billet, to which the steel plate is joined, is hot-pierced to produce a hollow shell. The hollow shell is rolled to produce a seamless pipe.

Concerning the piercing plug, it is preferable that the piercing plug comprises a main body made of any one of Mo, a Mo alloy and heat-resisting steel and a hard layer formed on the surface of the main body. The hard layer is made of any one selected from the group consisting of stellite, ceramics obtained by adding tungsten carbide to stellite, ceramics obtained by adding a mixture composition of tungsten carbide and cobalt to stellite and ceramics obtained by adding a compound of chromium and carbon to stellite. It is also preferable that the piercing plug comprises a plug body made of any one of Mo, a Mo alloy and a heat-resisting steel and a plug head formed at the leading end of the plug body and made of any one of Mo, a Mo alloy and a heat-resisting steel. The plug body can have a hard layer formed on the surface of the plug body. The plug head can have a hard layer formed on the surface of the plug head.

The contents of the embodiment-1 will now be described in detail.

Figure 6:
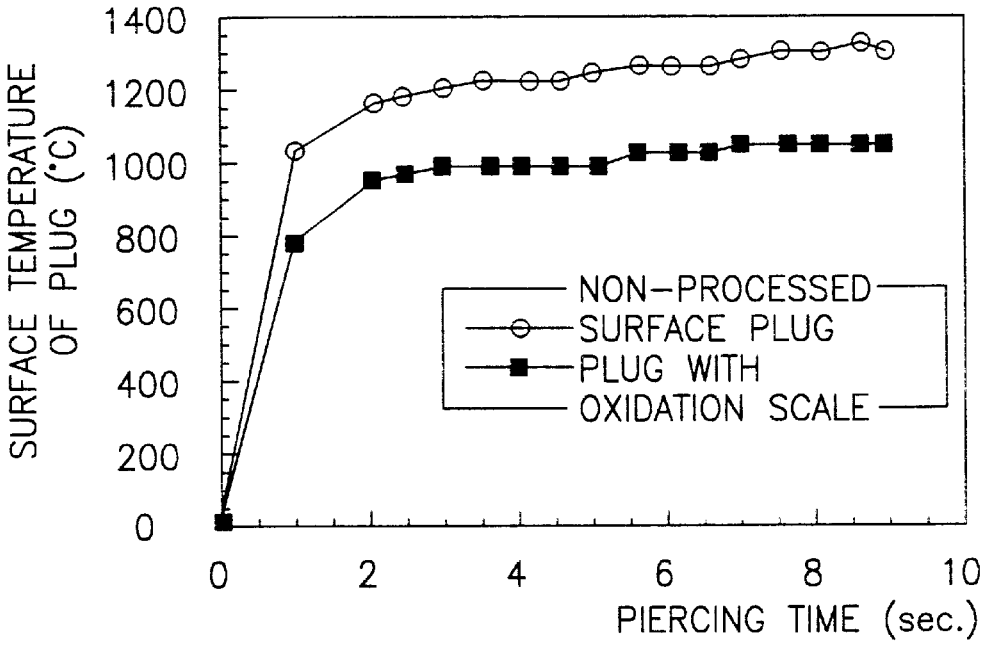
FIG. 6 is a graph showing the relationship between change in the temperature of the surface of the plug at a position near the leading end of the piercing plug, which is being used in the piercing operation, and the time required to complete the piercing work according to the embodiment-1.

The effect of elongating the life of the piercing plug made of Mo or a Mo alloy, which has been difficult to be used due to damage such as cracks, obtained due to joining of the steel plate is as follows:

On a view point that the plug is cracked and damaged due to the repeated thermal stress, the inventors of the present invention measured the surface temperature of the piercing plug made of Mo or the Mo alloy under conditions of piercing by using a model piercing mill similar to conditions when an actual mill is used. To make a comparison, also a plug which is used to pierce an alloy steel, which is made of a low-alloy steel and which has been subjected to an oxidation treatment was tested similarly. Results were shown in FIG. 6. Referring to FIG. 6, mark ○ represents a piercing plug made of Mo or the Mo alloy (a plug having a metal surface subjected to no treatment), square and solid black mark ■ represents a plug (a plug with an oxidation scale) made of a low-alloy steel and subjected to the oxidation treatment. As can be understood from FIG. 6, the temperature of the surface of the plug having the surface subjected to no treatment is always higher than that of the plug with an oxidation scale having scales on the surface thereof. The foregoing fact can be applied regardless of the material of the plug, even if the material of the plug is the heat-resisting steel or the Mo alloy. The plugs were cooled to the room temperature by air-cooling or mist cooling, followed by performing several times the piercing operation. As a result, surface cracks took place which has been known. Note that the heat-resisting steel is, in the embodiment-1, defined to be a steel "having a tensile strength of 30 $N/mm^2$" in the "high-temperature tension test at 1100° C. conforming to JIS G0567".

As for the piercing plug made of pure Mo, the plug previously heated prior to performing the piercing work and used in the piercing work in such a manner that the lowest temperature of the surface was set to be about 400° C., and a plug having a hardened surface such that the hard layer was formed on the surface by metal-spraying were forcibly cooled from the inside of the plugs. Thus, generation of defect could not be confirmed even after 10 times of the piercing work.

As a result, it was found that the plug having the surface on which the hard layer had been formed and the plug having poor resistance against thermal stress including the composite plug must be contrived such that a rise in the surface temperature is inhibited.

Figure 7:
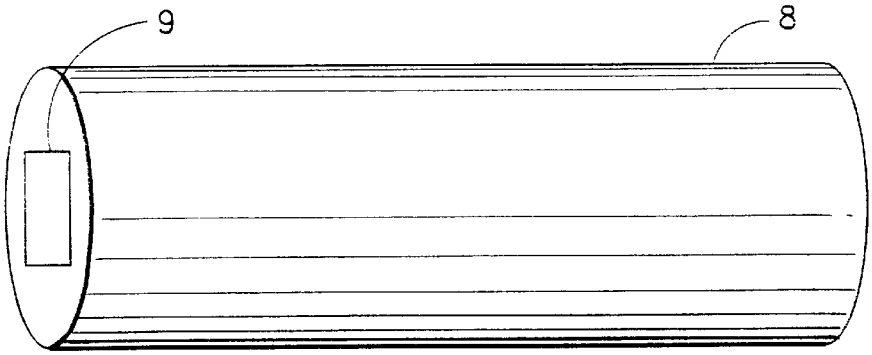
FIG. 7 is a perspective view showing a billet in which the steel plate is joined to the leading end surface of the billet according to the embodiment-1.
Figure 8:
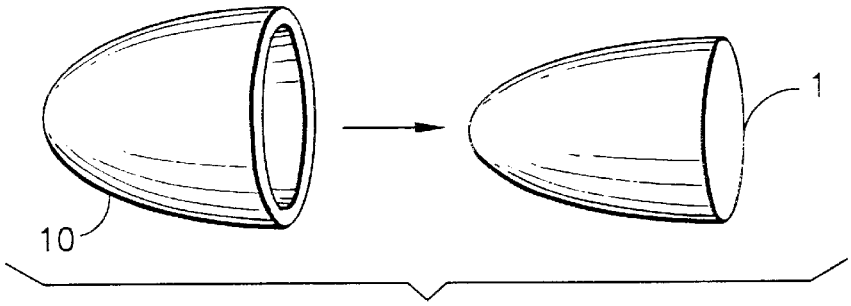
FIG. 8 is an exploded perspective view showing the piercing plug having the plug protective cover which has been subjected to the previous oxidation process according to the embodiment-1.

Based on this finding, the inventors of the present invention discovered the use of an oxidation scale capable of effectively serving as a heat insulating layer. That is, the discovered method is not the conventional method in which the piercing plug is previously subjected to an oxidizing treatment or a method shown in FIG. 8 and using a plug protective cover 10 subjected to the previous oxidizing treatment. The conventional methods involve loosing an oxidation scale serving as the heat insulating layer whenever the piercing work is performed. The discovered method is a method in which as shown in FIG. 7 scale is supplied from the billet and the oxidation scale is supplied to the plug whenever the piercing work is performed.

Figure 9:
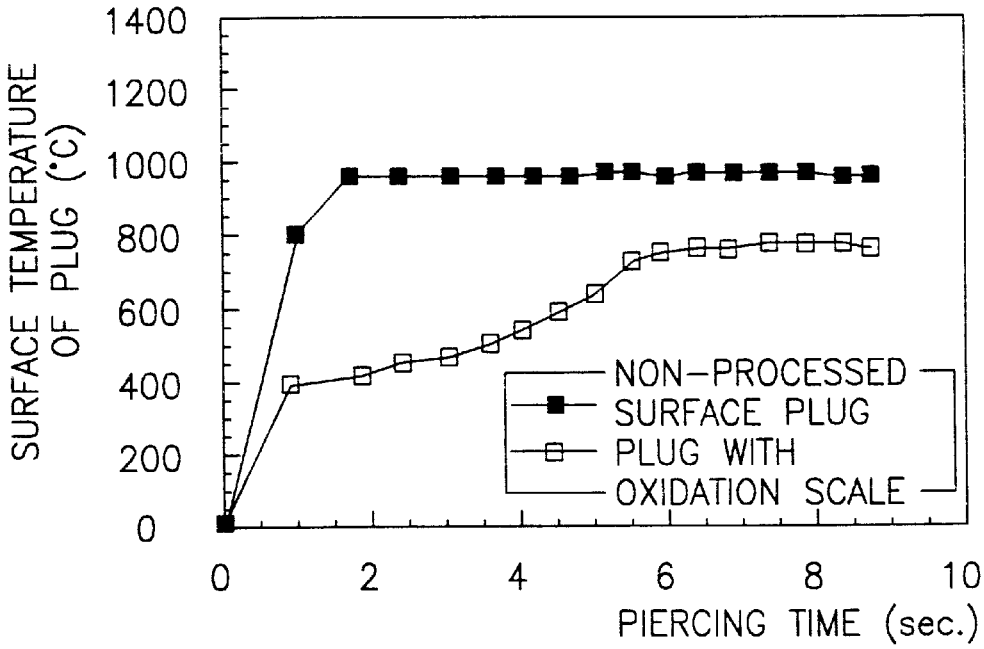
FIG. 9 is a graph showing a relationship between change in the temperature of the surface of the plug at a position near the leading end of the piercing plug, which is being used in the piercing operation, and the time required to complete the piercing work according to the embodiment-1.

The supply of the oxidation scale from the billet portion according to the present invention is capable of performing a similar operation which can be performed by a treatment for forming a oxidation scale film due to heat treatment. By using the foregoing supply, a rise in the temperature of the surface of the piercing plug can be prevented as shown in FIG. 9. Referring to FIG. 9, white and square mark □ represents a plug (plug according to the embodiment-1) to which an oxidation scale has been supplied from the billet portion, and black and square mark ■ represents a plug subjected to the process of forming the oxidation scale (the plug with the oxidation scale). Therefore, the oxidation scale, which has been enabled to be formed on only the conventional plug made of the alloy steel, can be formed on a plug made of Mo or the Mo alloy, which is sublimated at high temperatures. Thus, the life can effectively be elongated. Although the oxidation scale can be formed on the billet made of a high-alloy steel or the like, the foregoing effect cannot be expected from only the end surface of the billet in a case where the quantity of oxidation scale, which can be formed, is considerably small as compared with that in the case of the carbon steel or the low-alloy steel. Therefore, by positively shifting, to the piercing plug, the oxidation scale formed from the steel plate joined to the end surface of the billet so as to insulate heat, the thermal stress generating in the plug can be prevented, generation of cracks can be prevented and the durability of the plug can be elongated.

As for the plug having the surface on which a hard layer (hereinafter called a "hard layer") exhibiting satisfactory strength and/or wear resistance even under high atmospheric temperatures is formed, for example, a layer made of 30Cr—Co base alloy (stellite) or ceramics having a composition in which WC, WC—Co or $Cr_2C$ system is added to stellite, a reason similar to that described above can be employed. That is, the issue that foregoing method having an advantage as compared with the conventional plug cannot be employed because of separation of the hard layer taking place due to thermal stress can effectively be overcome by the method according to the embodiment-1 because the method is able to prevent separation. The reason for this is that the oxidation scale effectively serving as a heat insulating material is able to prevent thermal stress generating between the surface thereof and the base material of the plug. In addition to the foregoing materials, usual ceramics can be employed to form the hard layer as shown in Table 4.

The foregoing fact is also applied, for example, to the composite piercing plug formed to comprise a plug body and a plug head formed at the leading end of the plug body. In the foregoing case, deformation of the plug body, which has been considered a sole problem, can very effectively be prevented. A case where the foregoing hard layer is formed in the plug body and/or the plug head of the composite plug is similarly applied.

As a method of forming the hard layer on the surface of the plug body, any method may be employed, for example, metal-spraying, plating, a TD (VC) process, PVD (physical vaporization deposition) and CVD (chemical vaporization deposition).

In the case of the composite plug, use of a scale coating process using an oxidation process which has been employed for conventional plugs is included.

The present invention will now be described further in detail with reference to the following examples.

EXAMPLE 1

Figure 1:
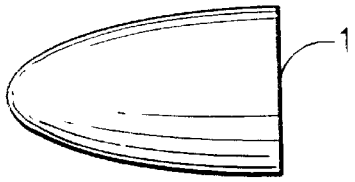
FIG. 1 is a cross sectional view of the piercing plug according to Example 1 of the embodiment-1.

As shown in FIG. 7, a billet formed by joining a steel plate 9 made of a general carbon steel to the end surface (hereinafter called a "leading end surface") of a billet 8 made of 13Cr on which piercing is commenced, and a billet having no steel plate joined thereto and made of general 13Cr were used. The material of a piercing plug 1 having a shape shown in FIG. 1 was varied within and without the scope of the embodiment 1. The Mannesmann piercing method was employed with an apparatus having a pair of rolls consisting of at least two rolls and two shoes to perform piercing under the following piercing conditions. The life of each of the used piercing plugs was examined. Results were shown in Table 1 as plug life ratios. The plug life ratios were evaluated by using a conventional plug made of 3Cr-1Ni as comparative example.

Piercing Conditions

Gorge rolling reduction: 7 to 15%

Heating temperature: 1050 to 1300° C. (varied according to steel type)

Billet diameter: diameter: (outer diameter 40 mm, 50 mm)

Billet Material: 13Cr

Material of Steel Plate Joined: general carbon steel

Size of Joined Steel Plate: 27 mm×27 mm×3 mm, 34 mm×34 mm×3 mm

TABLE 1

| Plug | Life Ratio of Plug | Joint Position | Evaluation | Remarks | |
|---|---|---|---|---|---|
| Conventional Steel (3Cr-1Ni) | 1.0 | — | x | Conventional piercing | Comparative Example 1 |
| Pure Mo | 9.1 | — | x | Cracked and Aboilshed | Comparative Example 2 |
| Pure-Mo | 28.0 | T | ◎ | | Example 1 |
| TZM | 17.8 | — | x | Cracked and Abolished | Comparative Example 3 |
| TZM | 35.0 min | T | ◎ | | Example 2 |

TABLE 1-continued

| Plug | Life Ratio of Plug | Joint Position | Evaluation | Remarks |
|---|---|---|---|---|
| TZC | 38.6 | T | ◎ | Example 3 |
| JIS-SUH31 | 29.2 | T | ◎ | Example 4 |

As shown in Table 1, Comparative Examples 1 and 2 and Example 1 of the embodiment 1 using plugs made of pure Mo were subjected to a comparison, thus resulting in that a fact being found that the life of the plug according to the embodiment 1 having the steel plate joined to the leading end surface of the billet can be elongated as compared with the plug according to Comparative Example 2 having no steel plate joined as described above. The plug according to Comparative Example 2 encountered cracks. Although omitted from Table 1, an Example in which the steel plate was joined to each of the two sides of the end surfaces resulted in a similar effect being obtained to that obtained in the case where the steel plate was joined to the leading end surface.

Comparative Example 3 and Example 2 of the embodiment 1 each using a plug made of TZM were subjected to a comparison, thus resulting in the knowledge that the life of the plug having the steel plate joined to the leading end surface of the billet can be elongated. Comparative Example 3 encountered cracks.

Example 3 using a plug made of TZC and Example 4 using a plug made of JIS-SUH31 resulted in the life of the plug being elongated because the steel plate was joined to the leading end surface of the billet.

EXAMPLE 2

Figure 2:
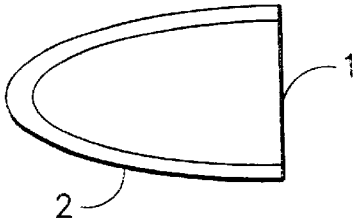
FIG. 2 is a cross sectional view of the piercing plug according to Example 2 of the embodiment-1.

Under the same conditions employed in Example 1, a plug body 1 was made of SKD61 employed by the conventional plug and a hard layer 2 composed variously as shown in Table 2 was formed on the surface of the plug body 1. A piercing plug having a shape shown in FIG. 2 was used to pierce the billet. The life of each of the used piercing plugs was examined. Results were shown in Table 2 as the plug life ratios. The plug life ratios were evaluated by using the life of the plug according to Comparative Example 1.

TABLE 2

| Main Component of Hard Layer on Surface | Life Ratio of Plug | Joint Position | Evaluation | Remarks | |
|---|---|---|---|---|---|
| Stellite | 2.4 | — | x | Conventional Piercing | Comparative Example 4 |
| Stellite | 15.3 | T | ◎ | | Example 5 |
| WC-Co + stellite | 27.7 | T | ◎ | | Example 6 |
| Cr2C + stellite | 22.3 | T | ◎ | | Example 7 |

As can be understood from Table 2, comparison of Comparative Example 4 and Example 5 using stellite as the main component of the hard layer 2 resulted in the knowledge that the life of the plug according to Example 5 in which the steel plate was joined to the leading end surface of the billet can be elongated. In the case where no steel plate was joined when the billet was pierced, a major portion of the cases resulted in the hard layer 2 was separated and/or damaged due to melting. The heat insulating effect of the embodiment 1 prevented the foregoing problem and, therefore, the life of the plug was elongated significantly. Although omitted from Table 2, an Example in which the steel plate was joined to each of the two sides of the end surfaces resulted in a similar effect being obtained to that obtained in the case where the steel plate was joined to the leading end surface.

Example 6 in which WC—Co was, as the main component of the hard layer 2, added to stellite and Example 7 in which Cr2C was added to stellite resulted in the life of the plug being further elongated as compared with Example 5 in which the hard layer 2 was made of only stellite.

EXAMPLE 3

Figure 3:
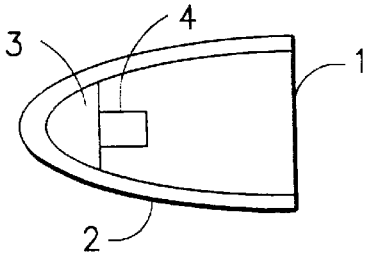
FIG. 3 is a cross sectional view of the piercing plug according to Example 3 of the embodiment-1.
Figure 4:
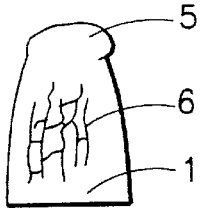
FIG. 4 is a side view of an example of the damaged piercing plug.
Figure 5:
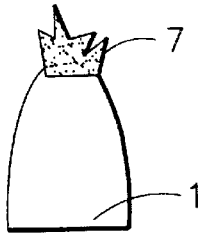
FIG. 5 is a side view of another example of the damaged piercing plug.

Under the same conditions as those employed in Example 1, a piercing plug consisting of a plug body 1 made of S45C and a plug head 3 joined to the leading end of the plug body by a head joining portion 4 and made of TZM and a piercing plug having the hard layer 2 having the composition shown in Table 3 and formed on the surface of the plug body 1 and that of the plug head 3 were used to pierce the billet. Each piercing plug had the shape as shown in FIG. 3. The life of each of the used piercing plugs was examined. Results were shown in Table 3 as the plug life ratios. The plug life ratios were evaluated by using the life of the plug according to Comparative Example 1.

TABLE 3

| Main Component of Hard Layer on Surface | Life Ratio of Plug | Joint Position | Evaluation | Remarks | |
|---|---|---|---|---|---|
| Stellite | 5.4 | — | x | Conventional Piercing | Comparative Example 5 |
| Stellite | 25.3 | T | ◎ | | Example 8 |
| WC-Co + stellite | 37.7 | T | ◎ | | Example 9 |
| Cr2C + stellite | 42.3 | T | ◎ | | Example 10 |

As can be understood from Table 3, comparison of Comparative Example 5 and Example 8 using stellite as the main component of the hard layer 2 resulted in the knowledge that the life of the plug according to Example 8 in which the steel plate was joined to the leading end surface of the billet can be elongated. The reason for this is that shortening of the plug due to separation of the hard layer can be prevented. Comparative Example 5 in which the steel plate was not joined to the leading end surface of the billet resulted in a similar effect obtainable from a low-alloy steel plug. Although omitted from Table 3, an Example in which the steel plate was joined to each of the two sides of the end surfaces resulted in a similar effect being obtained to that obtained in the case where the steel plate was joined to the leading end surface.

The life of the plug according to Example 9 in which WC—Co was added to stellite as the main component of the hard layer 2 and Example 10 in which $Cr_2C$ was added to stellite resulted in the life being further elongated as compared with Example 8 in which the plug was made of only stellite.

The components of alloy and the like for use in Examples were collectively shown in Table 4.

TABLE 4

| 13Cr Steel | SUS420 (J) Steel |
|---|---|
| 3Cr-1Ni | Low-alloy steel (C, Si and the like are contained by about 1 wt %), the main component of which is 3Cr-1Ni |
| TZN | 0.5 Ti-0.07 Zr-0.05C-balance Mo |
| TZC | 1.25 Ti-0.15 Zr-0.14 C-balance Mo |

TABLE 4-continued

| 13Cr Steel | SUS420 (J) Steel |
|---|---|
| stellite | Alloy containing about 30 Cr, 5 to 20 W and C, and balance Co |
| SKD61 | (Material conforming to JIS) |
| WC-Co | Ceramics composed of Wc and 50 wt % Co |
| Cr2C | Additive (Cr2C) |
| S45C | Material conforming to JIS (about SCC 5; 0.45C-0.5 Si-0.6 Mn-0.02 P-0.02 S-balance Fe) |
| Other hard layer (very hard material) | TiC, ZrC, VC, ZrC etc. (for example, JIS H5501, B4053) |

As described above, according to the embodiment 1, the durability of the plug can be improved which raises a problem when a seamless pipe is manufactured which is made of an alloy steel containing at least not lower than 5 wt % Cr or not lower than 5 wt % Ni, or an alloy containing, as the main component, any one of Cr, Ni and Mo. Thus, the efficiency in the rolling work can be improved and the tool cost can be reduced. Thus, a seamless pipe exhibiting additive value can be manufactured with a low cost. Thus, an industrial effect can be obtained.

EMBODIMENT 2

The embodiment 2 of the present invention provides a method for manufacturing a seamless pipe, comprising the steps of:

preparing a billet made of an alloy steel or an alloy;

joining a steel plate at least to an end surface at which piercing of the billet is commenced, the steel plate being subjected to an oxidation treatment;

heating the billet to which the steel plate is joined;

hot-piercing the heated billet by using a piercing plug to produce a hollow shell; and rolling the hollow shell to produce a seamless pipe.

The joining of the steel plate can be performed by welding.

Furthermore, the embodiment 2 of the present invention provides a method for manufacturing a seamless pipe, comprising the steps of:

preparing a billet made of an alloy steel or an alloy;

heating the billet in a heating furnace;

joining a steel plate at least to an end surface at which piercing of the heated billet is commenced, the steel plate being subjected to an oxidation treatment;

hot-piercing the billet, to which the steel plate is joined, by using a piercing plug to produce a hollow shell; and rolling the hollow shell to produce a seamless pipe.

The joining of the steel plate can be performed by forcible joining.

The billet can be made of an alloy steel containing Cr in an amount of at least 5 wt %, or an alloy steel containing Ni in an amount of at least 5 wt %. The billet can be made of an alloy, the main component of which is selected from the group consisting of Cr, Ni and Mo. The steel plate can be made of a carbon steel. Also, the steel plate can be made of an alloy steel containing one element selected from the group consisting of C in an amount of less than 5 wt %, Cr in an amount of less than 5 wt % and Ni in an amount of less than 5 wt %. Moreover, the steel plate can be made of an alloy steel containing Si in an amount of 1 wt % or more.

The contents of the embodiment 2 will now be described in detail.

Firstly, the effect of elongating the life of the piercing plug obtained due to joining of the steel plate is as follows:

As described before, Mannesmann piercing or plug piercing have drawbacks in regard to the plug, such as difficulty in external supply of a lubricant for preventing seizure and temperature rise. Moreover, since the piercing process is a severe work, there arises a problem of separation even if the lubricant is, in the form of a coating film, supplied prior to performing the piercing work. Therefore, even the oxide scale film, which is employed most widely, cannot be used in several passes of piercing cycles of an actual rolling operation. A problem in this case is that a previous supply of the lubricant encounters wanting of the lubricant during or in several times of the operation, thus causing the plug to be damaged. To prevent this, a supply of oxide scale from the billet portion capable of preventing seizure at each piercing work is effective. Moreover, the foregoing effect can be improved by simply increasing the number of the steel plates to be joined.

Since the foregoing method is performed prior to performing the piercing work, the following two methods are considered to be employed: (1) a method in which a steel plate previously subjected to oxidation treatment (hereinafter called a "previous-oxidized steel plate") is joined prior to performing heating, and then piercing is performed after heating and (2) a method in which the previously-oxidized steel plate is joined to the end surface of the billet after discharge from the heating furnace. The foregoing method (1) can be considered to be the best method because oxidation scale can further be produced in the heating furnace. On the other hand, in a case where the subject billet and the steel plate cannot easily be joined to each other, a method may be employed in which the previously-oxidized steel plate is forcibly fit at the time of performing centering which is performed after heating. Therefore, also the method (2) can be used preferably.

The foregoing previously-oxidized steel plate prevents contact between the plug and the billet made of the high-alloy steel as described above so that effects of heat insulating and lubricating the plug are obtained. This is one of characteristics of the embodiment 2. Therefore, if a steel plate which can easily seize with the billet, it is apparent that a satisfactory effect cannot be obtained. Thus, it is preferable that a steel plate be joined which contains a component for, in a large quantity, producing FeO or a compound of silicon oxide and iron at high temperature, for example, a general carbon steel, a high silicon steel containing not less than 1 wt % of Si, or a low-alloy steel containing less than 5 wt % C, Cr or Ni.

As a result of the method of elongating the life of the piercing plug according to the embodiment 2 enables the durability of the piercing plug to be elongated when a billet made of a high-alloy steel or the like is used to manufacture a seamless pipe. The life can be elongated by joining one or more previously-oxidized steel plates to the end surface of the billet and by performing the piercing operation. Thus, a high-alloy steel seamless steel pipe or a high-alloy metal seamless pipe can be manufactured by the same pipe manufacturing method while significantly elongating the life of the piercing plug. By manufacturing the produce by a method similar to the conventional method even after the pipe has been manufactured, the efficiency in the rolling work can be improved and the cost can be reduced.

Examples of the embodiment 2 will now be described in detail.

EXAMPLE 1

Figure 10:
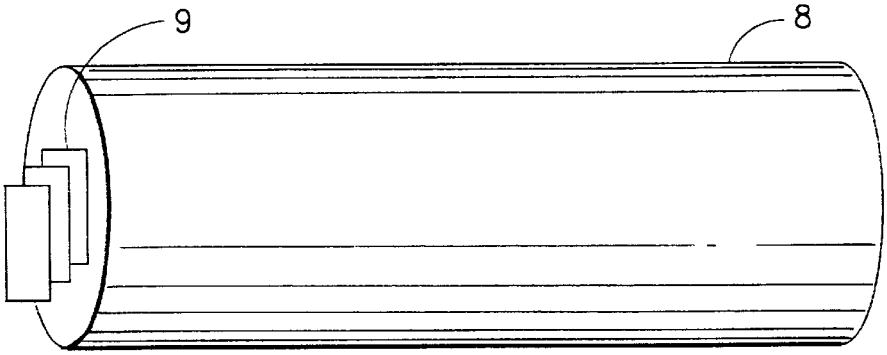
FIG. 10 is a perspective view of the billet having the leading end surface to which the previously-oxidized steel plate is joined according to the embodiment-2.
Figure 11:
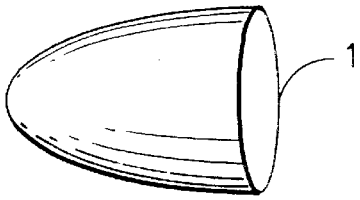
FIG. 11 is a cross sectional view of the piercing plug according to the embodiment-2.

As shown in FIG. 10, one or more previously-oxidized steel plates 9 obtained by subjecting a general carbon steel to an oxidation process were, by welding, joined to an end surface (joint position T), on which piercing was commenced, and/or opposite end surface (joint position B) of a billet 8 made of 13Cr steel. Thus, obtained billet, a billet to which a steel plate (hereinafter called a "non-oxidized steel plate") which was not subjected to the oxidation process and made of a general carbon steel, and a billet to which no steel plate was joined and made of a general 13Cr steel were used. A piercing plug 1 having a shape shown in FIG. 11 was used. The Mannesmann piercing method was employed with an apparatus having a pair of rolls consisting of at least two rolls and two shoes to perform piercing under the following piercing conditions. The previously-oxidized steel plate and the non-oxidized steel plate were joined before the billet 8 was injected into the heating furnace. The piercing plug 1 was made of an alloy steel (hereinafter called a "long-life alloy steel") prepared by adding Mo, V and W, which were components for improving the hot strength, to the conventional steel component (3Cr-1Ni steel) and exhibiting a life ratio of about two times that of the conventional plug when used in piercing. The life of each of the used piercing plugs was examined. Results were shown in FIG. 12 and Table 5 as plug life ratios. The plug life ratios were evaluated by using Comparative Example 1, in which no steel plate was joined to the steel plate, as the reference.

Piercing Conditions

Gauge rolling reduction: 7 to 15%

Plug Forward position: 80% to 97% (=the distance between rolls at the leading end of the plug/diameter of the billet)

Heating temperature: 1050 to 1300° C. (varied according to steel type)

Billet diameter: diameter: (outer diameter 170 mm, 230 mm)

Billet Material: 13Cr steel

Material of Plug: long-life alloy steel

Material of Steel Plate Joined: general carbon steel (previously-oxidized steel plate and non-oxidized steel plate according to Comparative Example)

Size of Joined Steel Plate: 0.3 S to 0.7 S where S is a vertical cross sectional area at the joint position B Timing at which the steel plate was joined: before and after the billet was introduced into the heating furnace, and after the same was discharged from the heating furnace

TABLE 5

| Number of steel plates to be joined | Timing | Plug life ratio | Joint position | Evaluation | Remarks |
|---|---|---|---|---|---|
| — | — | 1.0 | — | x | Comparative Example 1 Conventional Piercing |
| 1 | previous | 3.0 | T | Δ | Comparative Example 2 non-oxidized steel plate |
| | previous | 4.8 | T | ◎ | Example 1 |
| 1 | previous | 3.8 | B | ◎ | Example 2 |
| 1 | previous | 4.7 | TB | ◎ | Example 3 |
| 2 | previous | 8.7 | T | ◎ | Example 4 |
| 3 | previous | 14.6 | T | ◎ | Example 5 |

Figure 12:
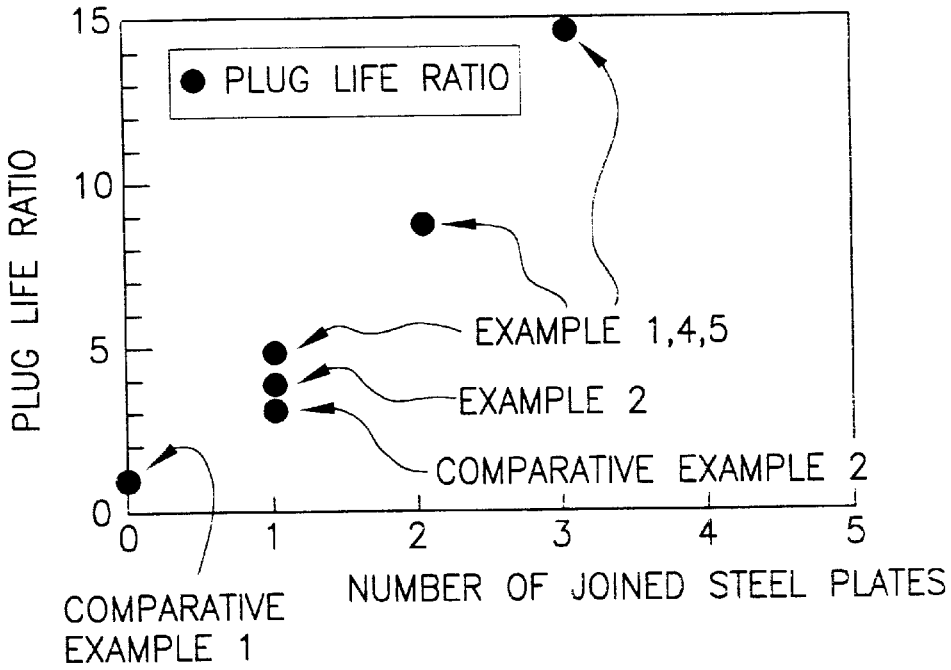
FIG. 12 is a graph showing the relationship among the plug life ratio, the number of steel plates and time in which piercing is performed according to Example 1 of the embodiment-2.

As shown in FIG. 12 and Table 5, Comparative Example 1 and Example 1 were subjected to a comparison. As a result, Example 1, in which the previously-oxidized steel plate was joined to the leading end surface of the billet, enabled the life of the plug to be elongated as compared with Comparative Example (general piercing) in which the billet alone was used.

Comparative Example 2 and Example 1 were subjected to a comparison, thus resulting in that Example 1 to which the previously-oxidized steel plate was joined to the end surface of the billet enabled the life of the plug to be elongated as compared with Comparative Example 2.

As can be understood from Examples 2 and 3, a fact was found that joining of the previously-oxidized steel plate to the rear end surface of the billet or to each of the front and rear end surfaces enabled the life of the plug to be elongated similarly to Example 1.

As can be understood from Examples 4 and 5, a fact was found that increase in the number of the previously-oxidized steel plate enabled the life of the plug to be further elongated as compared with Example 1.

EXAMPLE 2

Example 2 was performed under the same piercing conditions as those employed in Example 1 except joining of the previously-oxidized steel plate (the non-oxidized steel plate was employed in the comparative example) to the billet being performed after discharge from the heating furnace. The previously-oxidized steel plate (the non-oxidized steel plate was employed in the comparative example) was joined by press fitting when centering was performed after discharge from the heating furnace. The life of the plug after piercing was performed was examined. Results were shown in FIG. 13 and Table 6 as the plug life ratio.

TABLE 6

| Number of steel plates to be joined | Timing | Plug life ratio | Joint position | Evaluation | Remarks |
|---|---|---|---|---|---|
| — | — | 1.0 | — | x | Comparative Example 3 Conventional Piercing |
| 1 | later | 1.3 | T | x | Comparative Example 4 non-oxidized steel plate |
| 1 | later | 3.4 | T | ⊙ | Example 6 |
| 1 | later | 2.8 | B | ○ | Example 7 |
| 1 | later | 4.7 | TB | ⊙ | Example 8 |
| 2 | later | 6.7 | T | ⊙ | Example 9 |
| 3 | later | 10.6 | T | ⊙ | Example 10 |

Figure 13:
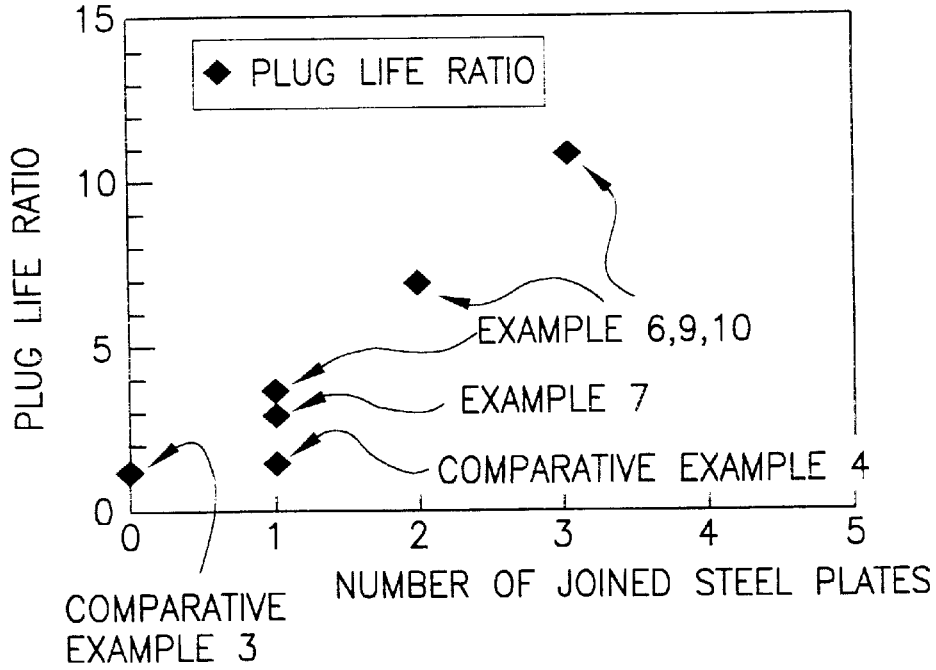
FIG. 13 is a graph showing the relationship among the plug life ratio, the number of steel plates and time in which piercing is performed according to Example 2 of the embodiment-2.

As can be understood from FIG. 13 and Table 6, an effect of elongating the life of the plug was obtained from Example 2 although it was somewhat shorter than that obtained in Example 1. Also in Example 2, a satisfactory effect was obtained due to increase in the previously-oxidized steel plates as can be understood from Examples 9 and 10.

EXAMPLE 3

Example 3 was performed under the same piercing conditions as those employed in Example 1 except the components of the previously-oxidized steel plate being varied. The life of the plug after piercing was performed was examined. Results were shown in Table 7 as the plug life ratio.

TABLE 7

| Steel Plate Type | No. | Timing | Plug Life Ratio | Joint Position | Evaluation | Remarks |
|---|---|---|---|---|---|---|
| General Carbon Steel | 2 | Previous | 8.7 | T | ◎ | Example 11 |
| Icr Steel | 2 | Previous | 4.0 | T | ○ | Example 12 STPA22 |
| 2.25 Cr Steel | 2 | Previou5 | 3.1 | T | ○ | Example 13 STPA24 |
| 5cr Steel | 2 | Previous | 2.4 | T | x | CE5 STPA25 |
| 9cr Steel | 2 | Previous | 1.6 | T | x | CE6 STPAZ6 |
| 13cr Steel | 2 | Previous | 0.9 | T | x x | CE7 SUS 410 |
| SUS304 | 2 | Previous | 0.6 | T | x x | CE8 18Cr-8N1 |
| SUS316 | 2 | Previous | 0.4 | T | x x | CE9 |

CE: Comparative Example

As can be understood from Table 7, Comparative Examples 5 to 9 in which a 5Cr steel plate, a 9Cr steel plate, a 13Cr steel plate, SUS304 and SUS316 steel plates containing components similar to those of the 13Cr steel plate selected as the base for the billet resulted in unsatisfactory effect of elongating the life of the plug. In particular, Comparative Examples 7 and 9 resulted in deterioration.

Examples 11, 12 and 13 in which the low-alloy steel, such as the general carbon steel plate, a 1Cr steel plate, a 2.25Cr steel plate, was employed resulted in apparent effect of elongating the life of the plug. A similar effect was obtained in the case where high Ni alloy steel (content of Ni: not less than 5 wt %) or an alloy, the main component of which was Cr, Ni or Mo was employed as the base for the billet.

As described above, according to the embodiment 2, a problem of unsatisfactory durability of the plug which arises when a seamless pipe made of an alloy steel containing not less than 5 wt % of Cr or not less than 5 wt % of Ni or an alloy, the main component of which is Cr, Ni or Mo, is manufactured can be improved. Thus, the efficiency in the rolling work can be improved and the tool cost can be reduced. Thus, a seamless pipe having additive values can be manufactured with a low cost. Thus, an industrial effect can be obtained.

EMBODIMENT 3

Figure 14:
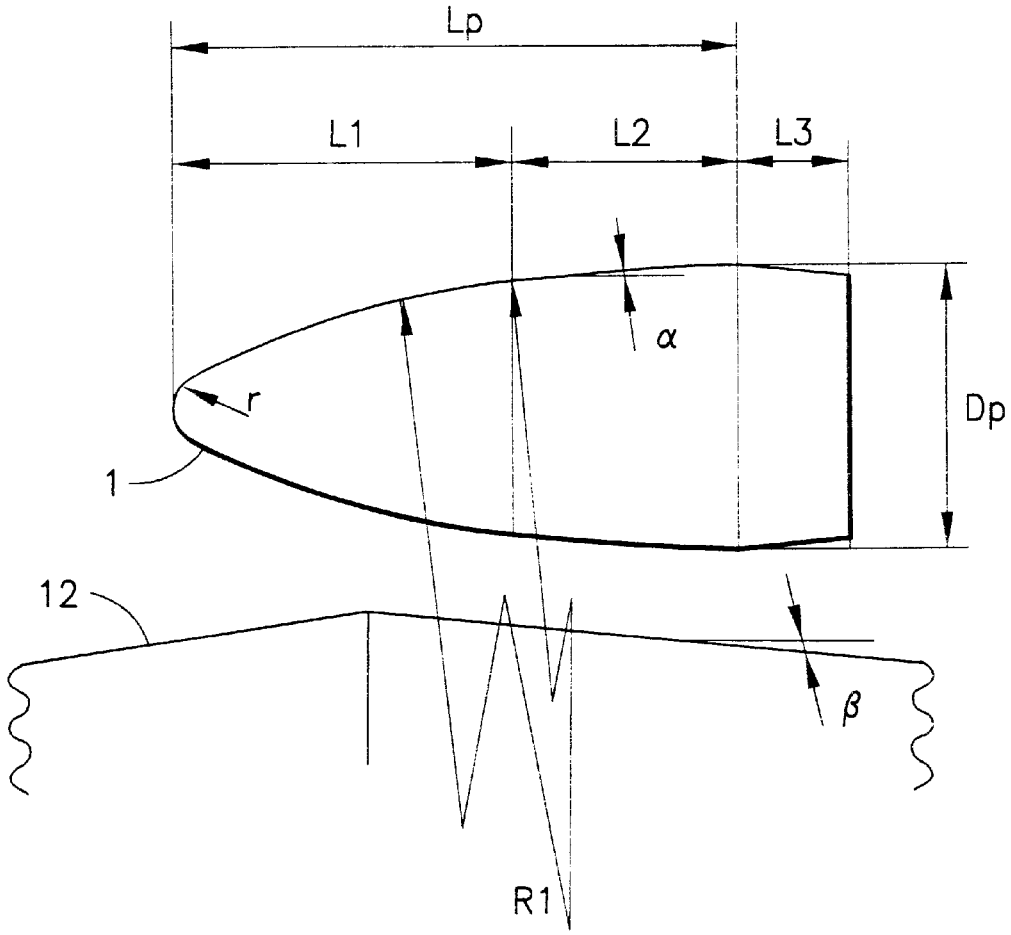
FIG. 14 is a schematic view of a plug roll according to the embodiment-3.

FIG. 14 shows the shape of the plug. Referring to FIG. 14, reference numeral 1 represents the plug, and 12 represents a piercing roll. The symbol Lp represents the effective length of the plug, L1 represents the length of the plug rolling portion, L2 represents the length of the plug reeling portion, and L3 represents the relief length of the plug. The overall length L of the plug is Lp+L3. The symbol Dp represents the diameter of the plug, R1 represents the radius of the plug reeling portion, r represents the radius of the leading end of the plug, α represents the angle of the plug reeling portion and β represents the angle of the roll outlet portion.

As disclosed in, for example, Elongated Steels, Steel Pipes and Common Facilities for Rolling, Steel Handbook III (2) edited by Japan Steel Association, Elongated Steel, pp. 935 and 936, design of a plug has been performed such that the plug consists of a leading end, a body and a relief portion. The front portion of the body has a rolling portion for mainly reducing the thickness and a reeling portion for finishing and obtaining the desired thickness. The reeling angle α is basically considered to be in parallel to the angle β of the outlet portion of the rolls. Therefore, α−β is 0° in the foregoing case. In general, α−β is made to be less than ±0.8°. The length of the reeling portion is, in many cases, made to be 1.0 time to 1.5 times with which the pre-processed pipe can be moved forwards. In Japanese Patent Laid-Open No. 61-137612, a plug capable of performing a piercing work while preventing thickness deviation has been disclosed having a structure such that the diameter of the plug is 141 mm, length of the same is 309 mm, the length of the reeling portion is 120 mm and the angle of the reeling portion is 2.5° when the angle β at the outlet portion of rolls is 3° and the inclination of the roll is 13°. In the foregoing case, α−β is −0.5. Examples of the foregoing case are shown in comparison with Comparative Examples A and B in Table 8.

The embodiment 3 is a characterized by a piercing plug for manufacturing a seamless pipe for use to pierce a billet made of a high alloy or a high-alloy steel for manufacturing a seamless pipe, the piercing plug for manufacturing a seamless pipe being characterized in that size of the plug satisfies the following equation:

$$0.8° \leqq \alpha-\beta \leqq 1.5°$$

where α is an angle of plug reeling portion, and β is an angle at the outlet portion of a roll.

Further, the embodiment 3 is characterized by a method of manufacturing a seamless pipe for manufacturing a seamless pipe by using a billet made of a high alloy or a high-alloy steel, the method comprising the step of using the plug for manufacturing a seamless pipe.

Furthermore, the embodiment 3 is characterized by a method of manufacturing a seamless pipe for a seamless pipe by using a billet made of a high alloy or a high-alloy steel, the method comprising the steps of joining a steel plate to a leading end of the billet in the moving direction, and piercing the billet by using the plug for manufacturing a seamless pipe.

The piercing plug for manufacturing a seamless pipe has the structure such that the angle α of the plug reeling portion is set to be the foregoing large range with respect to the angle β of the roll outlet portion. Therefore, the pressure of the plug contact surface can be reduced and, thus, the damage of the surface of the plug can be prevented. As a result, the life of the plug can effectively be elongated. The reason why α−β is limited to be 0.8° or larger is as follows. If the angle is smaller than 0.8°, the pressure of the contact surface cannot be reduced as desired and, therefore, the effect of elongating the life of the plug is unsatisfactory. The more the angle α−β is, the pressure of the contact surface of the plug can be reduced, thus resulting in satisfactory effect of elongating the life of the plug. If the angle is larger than 1.5°, deviation of thickness becomes critical for practical use. Thus, the angle α−β is set to be 1.5° or smaller.

Since the method of manufacturing a seamless pipe has the structure such that piercing is performed by using the piercing plug for manufacturing the seamless pipe, the plug cost can be reduced satisfactorily. The time required to change the plug can be shortened and deterioration in the efficiency in the rolling work can be prevented.

The method of manufacturing a seamless pipe has the structure such that a steel plate is joined to the leading end in the direction in which the billet is moved forwards in addition to the foregoing structure. Therefore, joining of the steel plate causes the life of the plug to be elongated as follows.

Although Mannesmann piercing or plug piercing causes an oxidized film of the plug to be melted to serve as a lubricant, the formed oxidized film is consumed during the piercing work. When a carbon steel is pierced, the oxidation scale is supplied from the carbon steel billet to the surface of the plug whenever piercing is performed. Thus, the thickness of the oxidation scale is sometimes made thicker than the oxide film of the plug before it is used in the piercing work. Therefore, the plug is able to withstand in hundreds of the piercing cycles. However, since the oxidation scale is not generated in a large quantity when a high alloy or high-alloy steel billet is pierced, the oxidation scale cannot be supplied to the surface of the plug. Thus, the life of the plug is shortened excessively. To considerably elongate the life of the plug when used to pierce a high alloy or a high-alloy steel, the oxidation scale must be supplied to the surface of the plug in a quantity larger than the quantity which is consumed.

The method of manufacturing a seamless pipe has the structure such that the steel plate is joined to the leading end of the billet in the direction in which the same is moved forwards, followed by being injected into the heating furnace so that oxidation scale is produced on the end surface of the billet. As a result, at a moment the plug comes in contact with the billet, the oxidation scale produced on the end surface of the billet can be supplied to the leading end of the plug. Therefore, life of the plug can significantly be elongated.

EXAMPLE 1

The plug according to the embodiment 3 and a conventional plug made of, for example, 13Cr steel, were subjected to a comparison about the life of the plug. Piercing conditions were set to be as shown in Table 8. Examples 1 to 4 had the size and piercing conditions of the plug according to the embodiment 3, while Comparative Example 5 had the size and piercing conditions of the conventional plug. The plug life ratios were as indicated by No. 1 and 2 shown in Table 9. As a result, use of the plug according to the present invention to perform piercing resulted in the life to be elongated to about two times. Note that the conventional plug having usual size was employed as the reference to which no steel plate was joined to the leading end of the plug to pierce the billet as indicated by No. 5 shown in Table 9.

Figure 16:
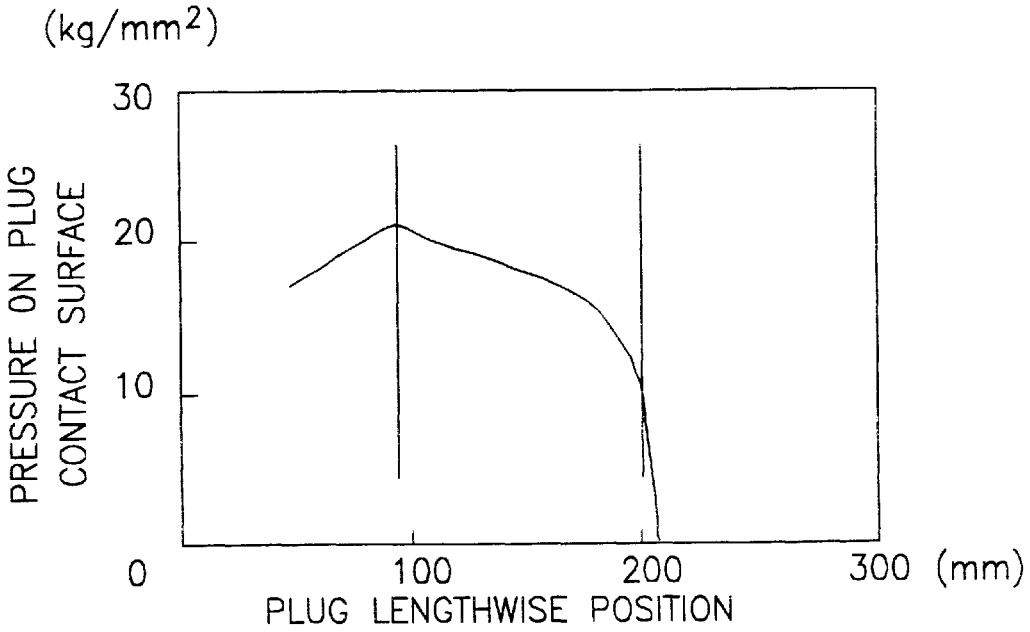
FIG. 16 is a graph showing an example of calculated load in rolling realized by the plug according to the embodiment-3.
Figure 17:
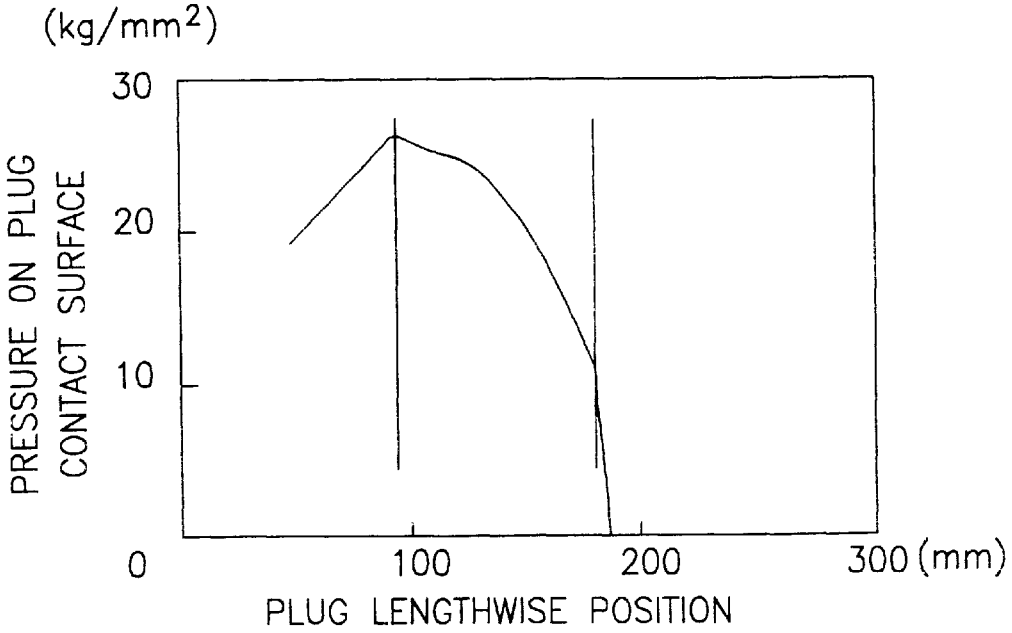
FIG. 17 is a graph showing an example of calculated load in rolling realized by the conventional plug according to the embodiment-3.

FIG. 16 shows an example of the pressure of the plug contact surface. In the case where the plug according to the embodiment 3 was employed, the peak of the pressure of the contact surface was reduced by 10% to 15%. Thus, it can be considered that the life of the plug can be elongated.

EXAMPLE 2

Figure 15:
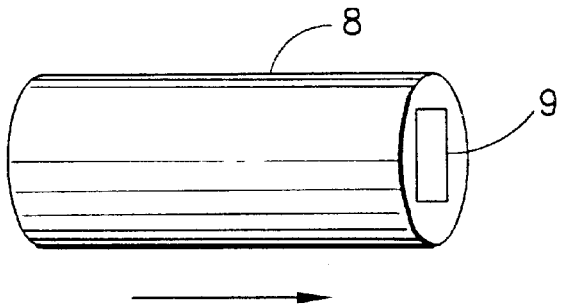
FIG. 15 is a schematic view of a billet and a steel plate joined to the end surface of the billet according to the embodiment-3.

As shown in FIG. 15, a billet 8 to which a steel plate 9 was joined to the leading end thereof in the moving direction such that the steel plate was joined to the leading end surface of the billet, and a conventional billet having no steel plate joined thereto were subjected to a comparison about the life of the plug in such a manner that the plug according to the embodiment 3 and a conventional plug made of a 13Cr steel was subjected to the comparison. The piercing conditions were the same as those employed in Example 1. The plug life ratios were as indicated by No. 3 and 4 shown in Table 9. As can be understood from Table 9, use of the plug according to the embodiment 3 and joining of the steel plate to the billet to perform piercing resulted in the life being elongated to about four times. Note that a conventional plug having a usual size was used as the reference to roll a billet having no steel plate joined thereto as indicated as No. 5 shown in Table 9.

TABLE 8

| Item | Unit | Example No. 1 to 4 | Comparative Example 5 | Comparative Example A | Comparative Example B |
|---|---|---|---|---|---|
| Plug Overall Length L | mm | 315 | 315 | 309 | 289 |
| Effective length Lp | mm | 265 | 265 | | |
| Diameter Dp | mm | 134 | 134 | 141 | 141 |
| Length of rolling portion L1 | mm | 190 | 190 | | |
| Radius of rolling portion R | mm | 476 | 437 | | |
| Radius of leading end r | mm | 20 | 22 | | |
| Reeling length L2 | mm | 75 | 75 | 120 | 50 |
| Reeling angle α | ° | 3.0 | 2.0 | 2.5 | 2.5 |
| Size of Roll | ° | 2.0 | 2.0 | 3.0 | 3.0 |
| Angle of outlet of rolls β | | | | | |
| α−β | ° | *1.0 | 0.0 | −0.5 | −0.5 |

Example No. 1 to 4: Piercing conditions of No. 1 to 4 of Table 9 (plugs according to the embodiment 3)
Comparative Example No. 5: Piercing conditions of No. 5 of Table 9 (conventional plug was used)
Comparative Example A: Example disclosed in Japanese Patent Laid-Open No. 61-137612
Comparative Example B: Conventional example disclosed in Japanese Patent Laid-Open No. 61-137612

TABLE 9

| No. | Plug | Billet | Life of plug | Remark |
|---|---|---|---|---|
| 1 | Example | Conventional 13Cr | 2.0 | Only plug according to the embodiment 3 |
| 2 | Example | Conventional 13Cr | 2.1 | Only plug according to the embodiment 3 |
| 3 | Example | 13Cr Present Invention | 4.0 | Plug and billet according to the embodiment 3 |
| 4 | Example | 13Cr Present Invetion | 4.5 | Plug and billet according to the enibodiment 3 |
| 5 | Conventional | Conventional 13Cr | 1.0 | Comparative Example (Conventional) |

(note 1)
Life of plug: magnification of reference which is Example 5

By improving the durability of the plug, which raises a problem when seamless pipe made of a high-alloy steel is manufactured, a technique can be provided with which the efficiency in rolling can be improved, the tool cost can be reduced and a high-alloy pipe having an excellent additive value can be manufactured.

What is claimed is:

1. A method for manufacturing a seamless pipe, comprising the steps of:

preparing a billet made of an alloy steel or an alloy having a main component selected from the group consisting of Cr, Ni and Mo;

joining a steel plate at least to an end surface of the billet at which a piercing of the billet is to be commenced;

preparing a piercing plug made of Mo, a Mo alloy or a heat resistant steel;

hot-piercing the billet at a hot-piercing temperature, to which the steel plate is joined, with the piercing plug by a Mannesmann piercing to produce a hollow shell;

an oxide scale being formed from said steel plate, at the hot-piercing temperature, the oxide scale lubricates the piercing plug during the hot-piercing;

rolling the hollow shell to produce a seamless pipe.

2. The method of claim 1, wherein said billet comprises an alloy steel containing Cr in an amount of at least 5 wt %.

3. The method of claim 1, wherein said billet comprises an alloy steel containing Ni in an amount of at least 5 wt %.

4. The method of claim 1, wherein said piercing plug comprises:

a main body made of any one of Mo, a Mo alloy and a heat-resisting steel; and a hard layer formed on the surface of the main body.

5. The method of claim 1, wherein said piercing plug comprises:

a plug body made of any one of Mo, a Mo alloy and a heat-resisting steel; and a plug head formed at a leading end of the plug body and made of any one of Mo, a Mo alloy and heat-resisting steel.

6. The method of claim 5, wherein said plug body has a hard layer formed on a surface of the plug body.

7. The method of claim 5, wherein said plug head has a hard layer formed on a surface of the plug head.

* * * * *